United States Patent [19]

Cochran

[11] 4,338,767

[45] * Jul. 13, 1982

[54] APPARATUS AND METHOD FOR REMOVING PRESSURE SENSITIVE SEALING TAPE FROM CONTAINERS

[75] Inventor: Donald D. Cochran, Bartlett, Ill.

[73] Assignee: National Can Corporation, Chicago, Ill.

[ * ] Notice: The portion of the term of this patent subsequent to Feb. 12, 1997, has been disclaimed.

[21] Appl. No.: 122,469

[22] Filed: Feb. 19, 1980

[51] Int. Cl.[3] ..... B65B 43/40

[52] U.S. Cl. ..... 53/492; 53/381 A; 198/484; 198/689; 271/98

[58] Field of Search ..... 53/381 A, 492; 271/98, 271/97, 195, 196; 198/689, 484; 414/744; 81/3.2

[56] References Cited

U.S. PATENT DOCUMENTS

| | | | |
|---|---|---|---|
| 2,995,883 | 8/1961 | Aubry et al. | 53/381 A |
| 3,067,552 | 12/1962 | Aubry | 53/381 A |
| 3,294,396 | 12/1966 | Staines | 271/98 |
| 3,845,605 | 11/1974 | Hartness | 53/492 |
| 3,891,205 | 6/1975 | Sunahara et al. | 271/98 |
| 4,187,662 | 2/1980 | Cochran | 53/381 A |

*Primary Examiner*—James F. Coan

*Attorney, Agent, or Firm*—Robert A. Stenzel

[57] ABSTRACT

In a seal removal station positioned along a bottle conveyor line upstream of a filling operation, oversized adhesive seals covering the mouths of plastic bottles are lifted off each bottle and transferred to a collector bin. Vacuum pressure generated in a plenum chamber formed in a stator member is transmitted to the non-adhesive upper surface of each seal through a perforated rotor surface rotating beneath the stator. Air jet means directing fluid pressure upward against overlapping marginal portions of each seal and guide surfaces to flatten out curled portions of the seal are utilized to assure seal lift off by virtue of fluid pressure differentials. A removed seal is kept adhered to the moving rotor surface by the maintenance of vacuum pressure above the seal. Adjacent to the collector bin, a further plenum having pressure air therein communicates through the rotor perforations with the adhered seal to propel the seal into the bin.

10 Claims, 12 Drawing Figures

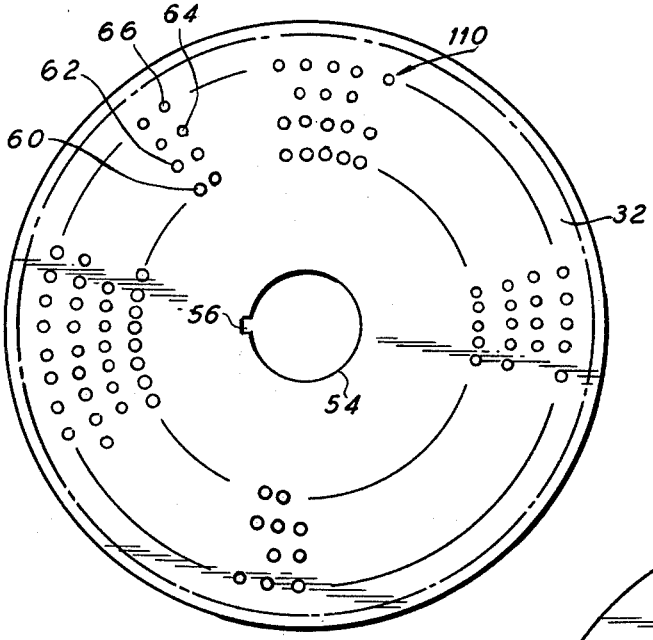
Fig. 3
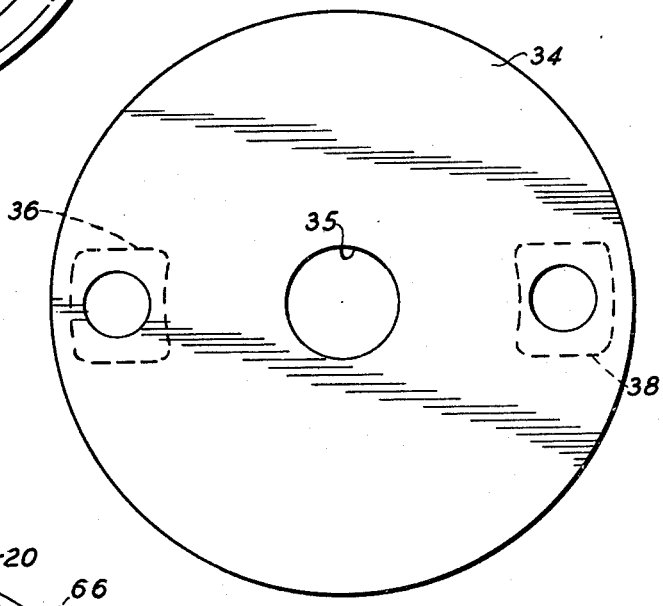
Fig. 4
Fig. 5
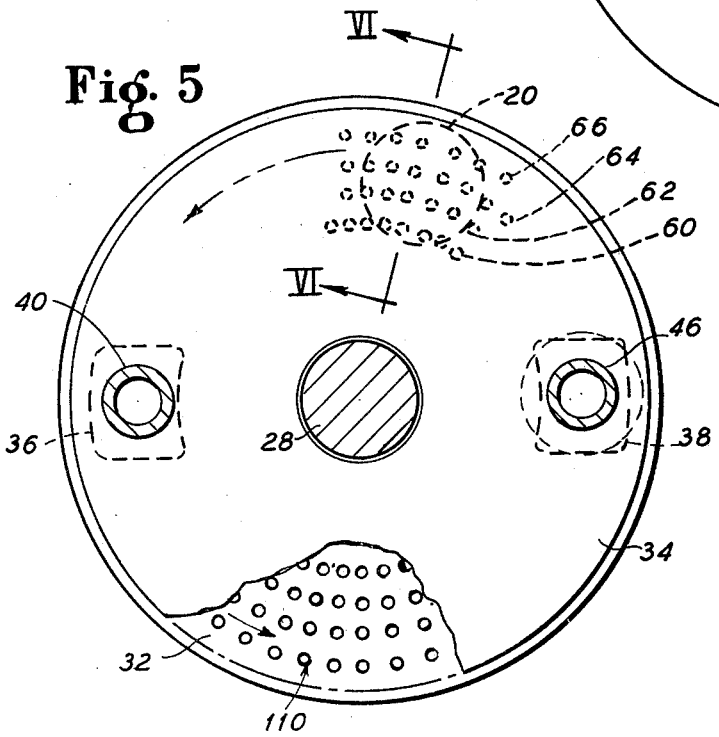
Fig. 6
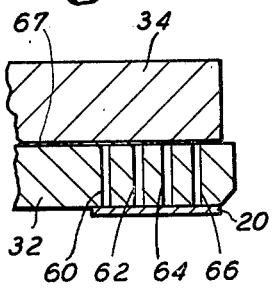

APPARATUS AND METHOD FOR REMOVING PRESSURE SENSITIVE SEALING TAPE FROM CONTAINERS

RELATED APPLICATION

My earlier application in this field, identified as Ser. No. 947,448, entitled "Apparatus For Removing Pressure Sensitive Tape From Containers", issued as U.S. Pat. No. 4,187,662 on Feb. 12, 1980.

BACKGROUND OF THE INVENTION

A. Field of the Invention

The invention relates to the field of container filling and, more particularly, to a method and means for removing temporary seals from containers as they pass into the filling line.

B. The Prior Art

In recent time, plastic containers have become increasingly utilized for the purpose of packaging milk or similar fluids. The plastic containers are usually blow molded from suitable plastic, such as polyethelene, at a manufacturing facility. The nature of the blow molding manufacturing process renders the interior of these containers sanitary. However, if, after the containers have been formed, they must be shipped, such as in a truck trailer, to a filling site or are otherwise exposed to foreign particles and vapors prior to filling, then additional steps need be taken so that the container interiors remain sanitary prior to being filled.

One method for insuring sanitary containers is to provide for a washing and sterilization of the inside of the containers just prior to being filled. This is extremely objectionable in that the installation of heavy and complex equipment would be required along the filling line.

A typical procedure for maintaining the initial sanitary condition of the blow molded plastic containers has been to package them at the manufacturing site in large polyethelene bags. The disadvantage of this procedure is that the packing is usually accomplished manually and unpacking similarly requires manual labor. Further, since the plastic containers are relatively lightweight, they often become crushed or irreparably dented during handling in the polyethelene bags.

There is disclosed in U.S. Pat. Nos. 2,995,883 and 3,067,552 a method for preventing glass containers from collecting foreign particles prior to being filled in which adhesive paper seals cover the mouth ends of the containers. U.S. Pat. No. 3,067,552 indicates that these seals are to be vapor-permeable to enable the evaporation of condensation occurring within the glass containers. U.S. Pat. No. 2,995,883 discloses nip roller means for removing the temporary seals from the container mouths. The sealed containers are spaced in seriatim on a conveyor and passed to the nip roller apparatus. Prior to reaching the seal removal rollers, a forwardly extending marginal portion of a seal is deflected upwardly by an air blast. While extending upwardly, the marginal portion of the seal is engaged by and maintained in its upwardly position by a guide wire leading to a nip between upper and lower rollers. The rollers rotate at high speed and in a forward direction to pull the seal off the container. The desealed containers pass under the lower roller and continue on their way to a filling machine or the like. This procedure would have unique disadvantages if utilized with plastic containers. Vapor-permeable seals would be ineffective for preventing entry of harmful vapors or water settling in blow molded sanitary containers. Since plastic containers are relatively lightweight, pulling a temporary seal from the container mouth would very likely lead to toppling of the container, which would threaten frequent jam-ups along the filling line conveyor. Further, since the lower roller comes into contact with the adhesive side of a temporary seal in this prior art procedure, there is the risk that seal surfaces will become glued to the lower roller or adjacent surfaces leading to a jam-up of the pinch roller operation.

SUMMARY OF THE INVENTION

The present invention provides for an automatic system for removing temporary seals from plastic container mouths as part of an efficient, effective system of maintaining blow molded plastic containers in a sanitary condition just prior to filling. The inventive system further overcomes drawbacks in prior art procedures by affording a continuous operation for cleanly and instantly removing temporary seals from the plastic containers.

According to the present invention, oversized adhesive seals cover the open mouths of plastic containers shortly after their manufacture. At the filling line, the sealed containers are placed in juxtaposed seriatim fashion along a conveyor which passes beneath seal removal equipment at a seal removal station prior to filling of the containers. In the seal removed station, a fluid pressure differential is applied across overlapping marginal portions of each seal so that the seal lifts off its container mouth and its non-adhesive surface adheres to a facing side of a rotor. The rotor passes the removed seal to a discharge area at which the adhering pressure differential is reversed and the removed seal is blown from the rotor into a bin. The rotor surface where removed seals adhere is provided with fluid ports, extending in a 360-degree array about the rotor axis. The fluid ports come into communication with a vacuum source when passing over the sealed container mouths and into communication with a pressure source when passing through the discharge area.

BRIEF DESCRIPTION OF THE DRAWINGS

FIG. 3 is a bottom plan view of the rotor for the seal removal equipment illustrated in FIG. 1.

FIG. 4 is a top plan view of the stator in the seal removal equipment illustrated in FIG. 1.

FIG. 5 is a top plan view of the rotor-stator assembly utilized in the seal removal equipment according to FIG. 1 having a portion cut away.

FIG. 6 is a partial cross-sectional view taken along the lines VI—VI of FIG. 5.

DESCRIPTION OF THE PREFERRED EMBODIMENT

The preferred embodiment of the present invention is concerned with removing temporary seals from blow-molded plastic milk containers or bottles being passed along a conveyor system leading to a filling line. However, those skilled in the art will readily appreciate that the present invention will have application with various other types of articles and containers.

Figure 1:
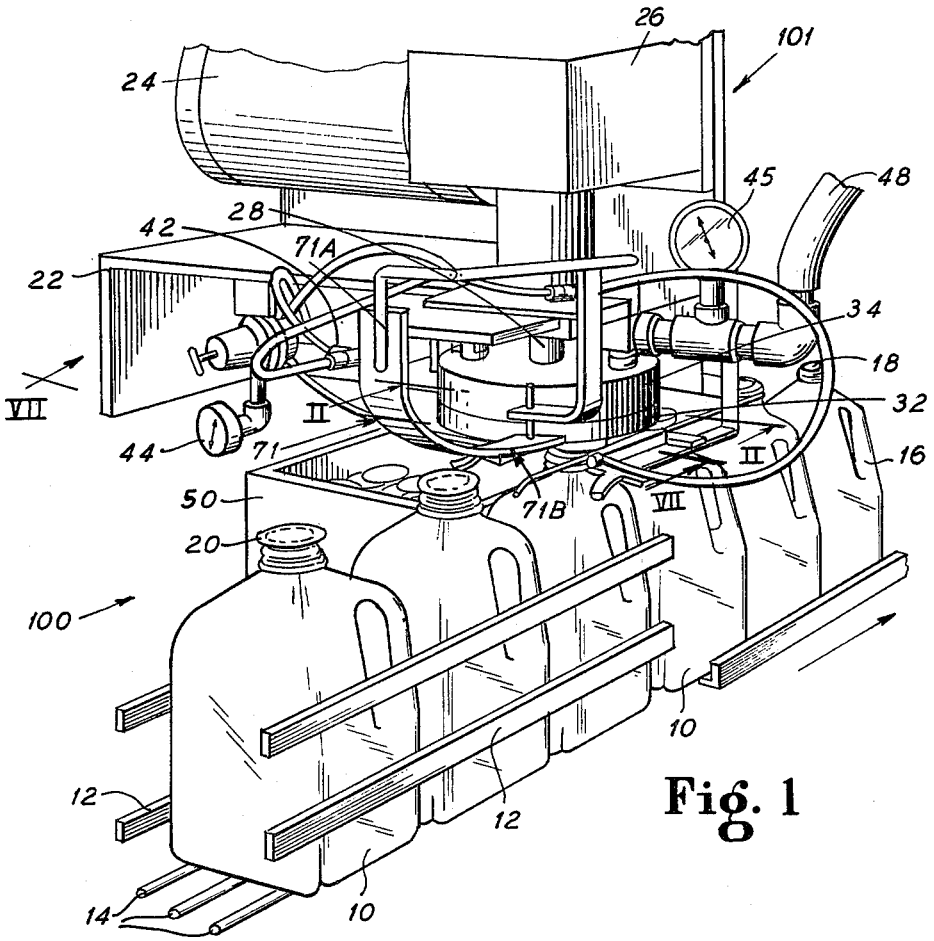
FIG. 1 is general perspective view of seal removal equipment according to the present invention acting on sealed plastic containers.

FIG. 1 illustrates a line of plastic milk bottles 10, which may be manufactured by blow molding, being transported in juxtaposed seriatim fashion on a conveyor means, such as a linearly movable belt (not shown). The conveyor means may be part of a filling line conveyor or lead onto a filling line conveyor system. Guide rail means including side rails 12 and bottom support rails 14 serve to align the bottles 10 as they enter a seal removal station 100 located upstream of the milk filling operation.

The bottles include handle portions 16 and are provided with a top mouth opening 18 through which the containers are filled and from which liquids received therein are subsequently dispensed by the consumer. At the manufacturing plant, each bottle 10 is provided with an oversized and generally circularly shaped seal 20 disposed over the bottle mouth 18. The seals 20 are generally in the form of pressure sensitive tape, having a pressure sensitive adhesive on their underside surfaces 20A. The seals 20 are placed on the containers as early as practicable after manufacture to insure that the interior of the containers remain in a sanitized condition after a sanitary blow-molding process. The seal application can be accomplished in any desired manner, such as manually. Thereupon, the sealed bottles 10 may be transported, such as in a truck trailer, to the dairy for filling without having to be sealingly contained in special bags or cartons. Even if truck transport of newly manufactured bottles is not required, such as if the bottle manufacturing plant were located at the dairy, seals 20 may be provided to prevent entry of foreign particles and vapors into the containers prior to filling, while, at the same time, enabling individual handling of the bottles and obviating the need for sanitized conditions or containment means. Each seal 20 is, preferably, removed just prior to the bottles being conveyed into a filling station, which may include automatic filling machinery of the type usually found in a dairy or other bottling plant. Seal removal is accomplished at station 100 by means of a continuous, lift-off operation performed by the seal removal equipment illustrated in FIG. 1.

The seal removal mechanism is designated generally as 101. The mechanism is mounted on a L-shaped bracket member 22 so as to overlie the bottle conveyor. The seal removal mechanism is motor-driven by means of a small horsepower electric motor 24 through a gear box 26. As somewhat schematically illustrated in FIG. 2, a drive shaft 28 extends downwardly from the gear box passing through a suitable opening in a drip shield 30 provided to prevent lubricants or other contaminates from passing beneath the support bracket 22 and onto the bottles 10. A rotor member 32 is fitted by lock means 86 to the end of the drive shaft 28 for rotation therewith. A stator member 34 is mounted above the rotor so as to be free-floating along the upper surface thereof. A central orifice 35 extends axially through the stator 34 to allow for passage of the drive shaft therethrough. The central orifice 35 is large enough to allow for clearance between the drive shaft 28 and the interior surface of the orifice 35 such that the drive shaft does not engage the stator.

Figure 8:
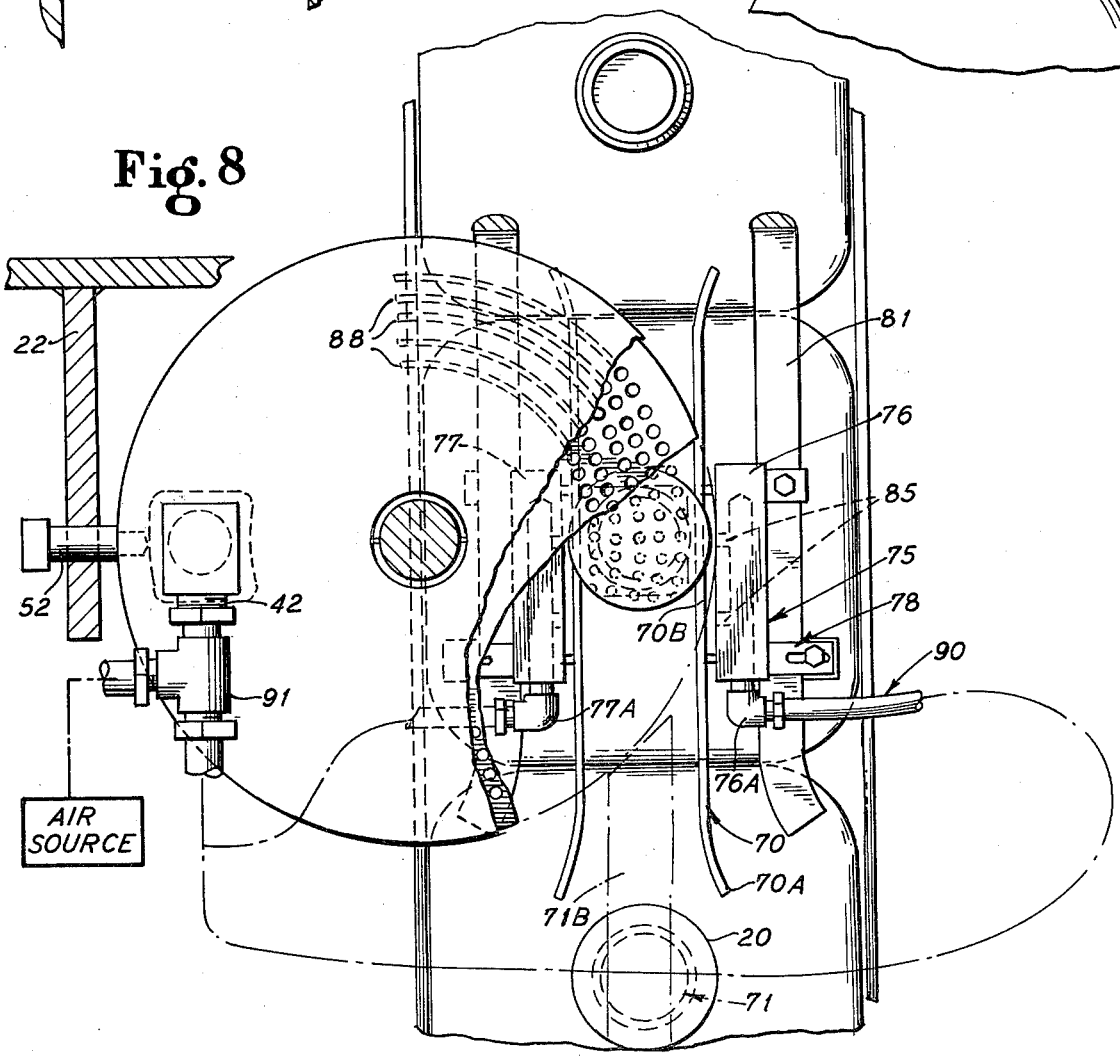
FIG. 8 is a cross-sectional view taken along the lines VIII—VIII of FIG. 7.

Referring to FIG. 3, the construction of the rotor can be seen in detail. The rotor is a relatively thick circular disk having a central opening 54 including a key way 56 for positively engaging the drive shaft for rotation therewith. A series of fluid ports 110 extending through the rotor are provided in an array extending 360° around the rotor axis and concentric with the central opening 54. Fluid ports are arranged into four rings designated from the radially innermost to the radially outermost as 60, 62, 64, and 66. A greater or lesser number of rings or fluid port arrangements could be provided, such as shown in FIG. 8. In accordance with the preferred embodiment, the apertures in each ring are on the order of 1/16 inch in diameter and spaced approximately 5° apart.

Figure 2:
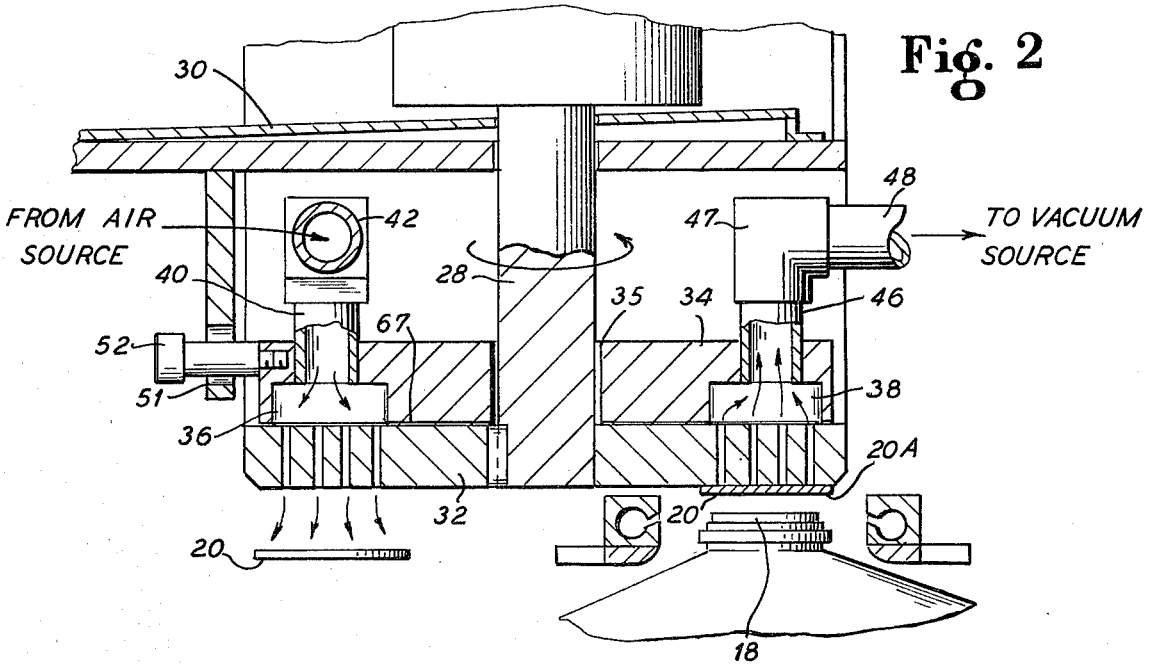
FIG. 2 is a partly schematic cross-sectional view taken along the lines II—II of FIG. 1.

As illustrated in FIGS. 2 and 4, the stator 34 has provided therein a pair of plenum chambers or manifolds 36 and 38, which are spaced 180° apart on opposite sides of the drive shaft 28. Plenum 36 is connected to a channel 40 which terminates in a coupling member 42 connected to a source of air pressure (preferably, about 5 psia) supplied via a flexible hose (not shown). If desired, an air pressure gauge 44 may be provided to accurately determine the air pressure applied to the plenum 36. Plenum 38 communicates with a channel 46 which terminates in a coupling 47, having connected thereto a vacuum line, generally comprised of flexible hose, ultimately connected to a vacuum source, such as a pump (not shown). If desired, a gauge 45 may be provided to accurately determine the vacuum pressure maintained in the plenum 38.

As the rotor 32 rotates with the drive shaft 28, the stator 34 does not move. A shoulder bolt means 52 extends through an opening 51 formed in a flange portion of the mounting bracket 22 and is secured at its inner end screw threads in a suitable opening in the stator 34. Opening 51 closely confines the shoulder bolts circumference in the lateral direction such that plenums 36 and 38 are positioned as desired relative to the bottle conveyor line. However, vertical adjustment of the stator-rotor assembly is also afforded so that the seal lift off surface of the rotor 32 may be properly positioned relative to the bottle seals 20 for various bottle sizes and shapes. To enable vertical movement opening 51 is elongated in the vertical direction and the rotor 32 is adjustably fitted at the lower end of the shaft 28 by a taper lock means 86. In an alternative not shown, the entire bracket mounting and the base plate to which bracket 22 is attached may be vertically adjustable along a vertical support column by means of a releasable split collar clamp mechanism. In addition to vertical adjustment of the stator-rotor assembly, the horizontal plane of the assembly is adjustable by means of pivotable movement of the bracket 22 about a shoulder bolt 87. Accordingly, further bolt securements for the bracket 22 lie in properly elongated slots.

With reference to FIGS. 5 and 6, the function of the rotor-stator assembly will be described. The stator 34 is positioned so that plenum 38 is located directly over the bottle mouths 18 as the bottles 10 pass through the seal removal station 100. The pressure air plenum 36, located across the drive shaft 28 from the plenum 38, has positioned directly beneath it a seal collector means, shown in FIG. 1 as bin 50. As the rotor rotates beneath the stator, the fluid ports 110 communicate with vacuum pressure as they pass beneath the plenum chamber 38. It is at this point that a seal 20 is lifted from its bottle mouth 18 in a manner to be more fully described below. The non-adhesive side of the seal 20 becomes attached to the bottom wall of the rotor 32 in the vicinity of plenum 38 by virtue of the sub-atmospheric pressure applied across the upper surface of the seal 20 through the fluid ports 110 in communication with the plenum 38. As the rotor 32 continues to rotate, the removed seal 20 remains adhered to the bottom of the rotor since sub-atmospheric pressure is sealed within the fluid ports 110 to which the seal 20 is attached. Sealing of the fluid ports during their travel between plenum chamber 38 and plenum 36 may be accomplished by interposing concentric seal strips or lapped surfaces between stator and rotor surfaces. In accordance with the preferred embodiment, there is provided a seal surface 67 formed on one or both of the abutting walls of the rotor and stator. The seal surface 67 may be formed of a Teflon-impregnated bronze. Subatmospheric pressure is further assured of being maintained above the removed seal adhering to the rotor 32 by means of concentric grooves 88 formed in the stator. The grooves each communicate at one end with the vacuum plenum 38 and overlie a respective ring of fluid ports. Preferably, the grooves 88 do not terminate until they are no longer overlying the bottle conveyor in order to obviate release of removed seals over the flow of bottles were their accumulation may lead to a jam-up in the bottle movement. The removed seal 20 is carried by the rotor beneath the plenum chamber 36, where the fluid ports communicating at their lower end with the non-adhesive surface of the seal are brought into communication at their upper ends with the pressure plenum 36. This action reverses the pressure differential on the adhered seal 20 such that the seal is now propelled away from the rotor 32 and falls into the bin 50. The rotor continues turning and the lift-off process repeats.

By providing a plurality of holes over 360° of the rotor 32, it is unnecessary to synchronize the operation of the seal removal drive with the operation of the bottle conveyor mechanism. Whenever a bottle passes beneath the vacuum plenum 38 the seal will be lifted from the bottle onto whatever sector of the rotor is then positioned in alignment with the plenum. This rotating pick off action results in a highly efficient seal removal mechanism capable of handling from 10 to 75 containers per minute, speeds which are fully compatible with automatic filling equipment presently utilized.

Figure 7:
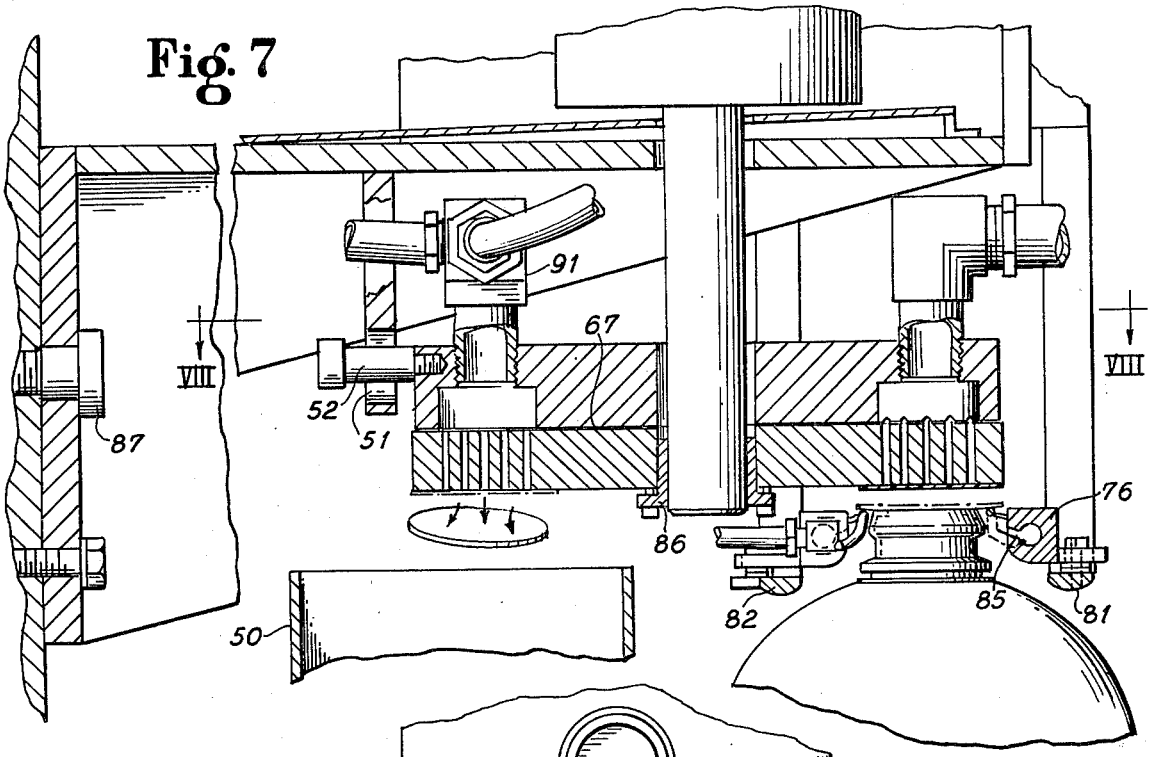
FIG. 7 is a cross-sectional view, partially left out, taken along the lines VII—VII of FIG. 1.

Referring now more specifically to the details of the seal removal mechanism 101 as illustrated in FIGS. 7 and 8, each seal 20 is sized larger than the bottle mouth opening 18 so as to have overlapping marginal portions. The seals are preferably circular as this shape is much less prone than rectangular shapes to have curled edge surfaces which obstruct with the rotor 32. As each sealed bottle mouth enters the seal removal station 100, guide bar means 70 confines the bottle mouth along a fixed liner path so as to pass the seal directly beneath the vacuum plenum 38. The guide bar means comprises generally parallel bars defining a converging upstream inlet end 70A to receive each bottle neck. The forward-most ends of the bars are spaced downwardly from the midsection 70B of the guide means 70 such that the bars define an inclined planar surface which will deflect downwardly curled marginal portions of the seal 20 into a generally flattened condition by the time the bottle mouth 18 passes beneath plenum 38. To deflect upwardly curled marginal portions, there is provided an arcuate guide surface 71 which descends from an upstream end 71A, located spaced above the bottles 10 as they enter the station 100, to a downstream end 71B. The downstream end provides a planar surface over the seals 20 which leads to adjacent the bottom side of the rotor 32. Preferably, seals 20 pass into the station 100 extending in a generally flat or planar condition since their overlapping edge portions are positioned between the guide bars beneath and the guide surface 71 above. However, as a further precaution against upwardly curled seal edges from contacting the bottom surface of the rotor 32 and thereby leading to interference with the seal removal operation, the bottom surface of the rotor is not positioned too close to the upper planar surface of the seals 20. On the other hand, the seals must pass beneath the bottom surface of the rotor not greater than 1/16 inch for vacuum pressure of about 15 inches of mercury in order to avoid diffusion of the vacuum force and maintain a sufficient force to break the seal's adhesive force on the bottle.

Each seal 20 is instantly removed from its bottle mouth 18 by means of a pressure differential created across overlapping edges of the seal as it is passed beneath vacuum chamber 38. The pressure differential created with the ambient by the vacuum in plenum 38 is selected to be ordinarily sufficient to overcome the adhesive force of a seal. However, since even one unremoved seal results in spillage at the filling station which could disrupt the entire filling operation as well as create a safety hazard, the applied pressure differential may be enhanced to assure that no seal will be able to withstand the lift-off force. Accordingly, pressure fluid jet means 75 are positioned about the bottle necks as they move beneath the vacuum chamber 38.

The jet means 75 comprises two manifold means 76 and 77, each serving to support a respective bar member of the guide means 70. The manifolds 76 and 77 themselves are fitted with slip-fit bracket means 78 which are bolted to stationary mounting arms 81 and 82 spaced apart across the flow of bottles through the seal removal station 100. The slip-fit bracket means enable lateral position adjustment for each of the air manifolds and guide bars, so as to accommodate various bottle mouth widths. Each manifold is formed with a plurality of jet nozzles 85 facing upwardly and inwardly in relation to the flow of bottle necks between the manifolds 76 and 77. The jet nozzle means 85 communicate with a manifold supply of above atmospheric pressure passed into each respective manifold by respective connector means 76A and 77A. These are connected with a source of pressure air utilized in plenum 36 by means of flexible hoses 90 fluidly connected to one end of a T-branch conduit 91. The other ends of the T-branch 91 communicate respectively with the source of pressure air and coupling 42 leading to the pressure air plenum 36.

ALTERNATE EMBODIMENT

Figure 9:
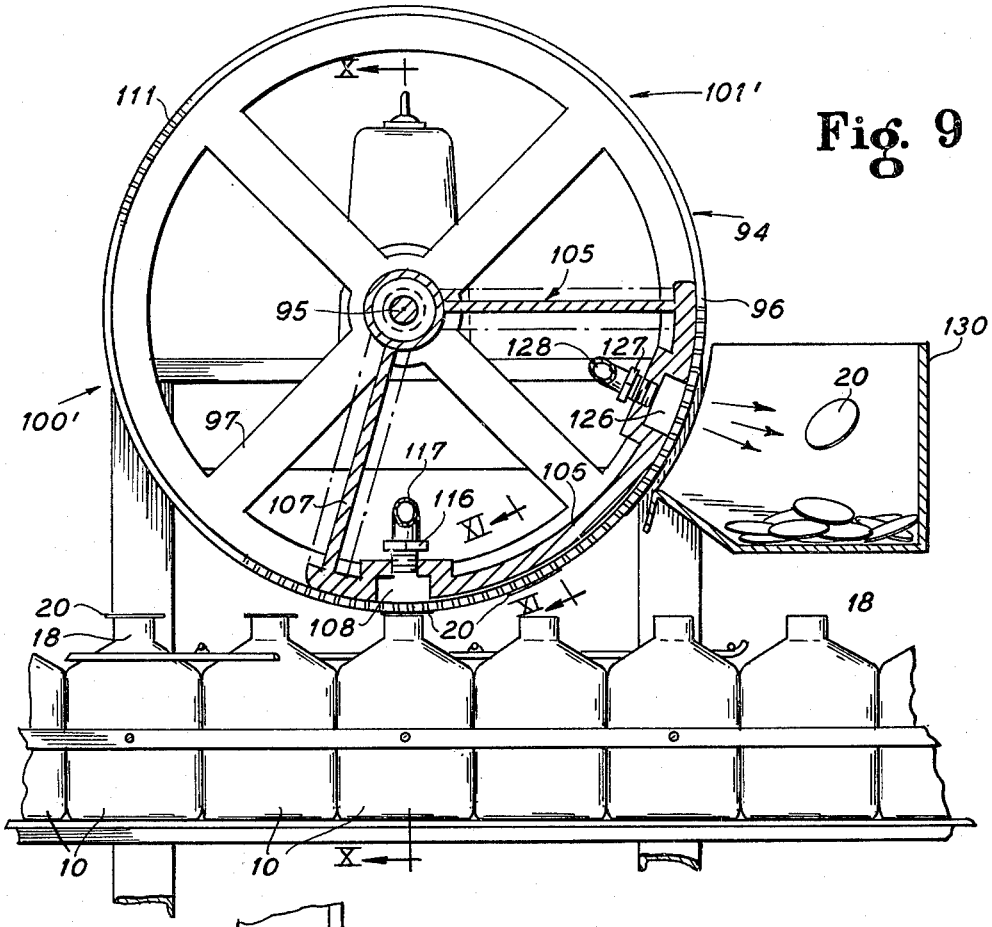
FIG. 9 is a cross-sectional view of an alternate embodiment for the seal removal equipment according to the present invention.
Figure 10:
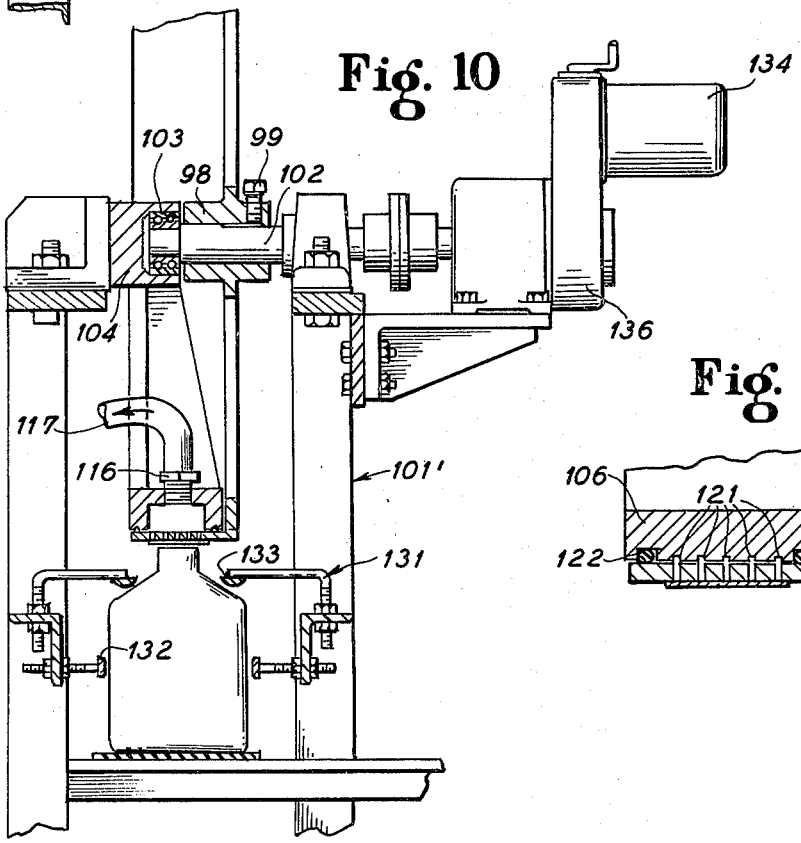
FIG. 10 is a cross-sectional view taken along the lines X—X of FIG. 9.
Figure 11:
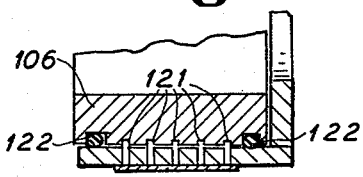
FIG. 11 is a partial sectional view of the rotor and stator engagement portions of the seal removal equipment according to FIG. 9.

FIGS. 9–11 illustrate a seal removal station 100' utilizing alternate seal removal equipment 101' according to the present invention. The alternate seal removal equipment 101' comprises a circular hub rotor 94 which rotates about a horizontal axis 95. The rotor 94 includes a circumferential surface 96 which is perforated in parallel rings throughout its 360° length with fluid ports 111. Extending radially inward from one end surface of the circumferential surface 96 are radial arm support members 97 which terminate at their radial inward end in a hollow hub 98. The hollow hub fits concentrically onto a rotatable drive shaft 102 by means of a lock nut connector 99 formed on the hub 98. Adjacent the hub 98 is a thrust bearing chamber 103 supporting one end of the drive shaft 102. The bearing chamber 103 is mounted in a hub-like housing 104 which is fixedly supported in the seal removal station 100'.

The stationary housing 104 serves as support for a stationary stator member 105 which fits radially inside of the circumferential rotor surface 96. The stator 105 comprises an approximately 110° arcuate surface 106, which fits in adjacent concentric fashion radially inward of the rotor surface 96 and is supported there by means of radial support arms 107 extending between the arcuate surface 106 and the stationary housing hub 104. A lower end of the stator surface 106 is formed with an interiorly located plenum chamber 108. The plenum 108 communicates with a channel 116 which, in turn, is connected to a vacuum line 117 ultimately connected to a vacuum pump (not shown). Extending upwardly from the plenum chamber 108 along the radially outer surface of the stator wall member 106 are a plurality of grooves 121, each groove extending over a respective row of fluid ports, as illustrated in FIG. 11. These grooves terminate at about a 50° length from the vacuum plenum 108. Adjacent to, but mounted further upward from, the termination point of the grooves 121, is a plenum chamber 126, positioned interiorly of the stator member 106. Plenum 126 is connected to a channel 127 which, in turn, is connected to a source of air pressure (not shown) via a conduit means 128. The pressure plenum 126 faces across the perforated rotor surface 96 into a collector means, shown as a bin 130, which stores removed bottle seals 20.

The stator 106 is positioned so that plenum 108 is located directly over the bottle mouths 18 as the bottles 10 pass through the seal removal station 101'. As the rotor rotates beneath the stator 105, the fluid ports 111 communicate with vacuum pressure as they pass beneath the plenum chamber 108. At this point, a seal 20 is lifted from its bottle mouth 18. The non-adhesive side of the seal 20 becomes attached to the radially outermost surface of the rotor 94 upon removal from the bottle mouth 18. As the rotor surface 96 continues to rotate, the removed seal remains adhered to the rotor surface. Sub-atmospheric pressure continues to be applied through the fluid ports 111 opening onto the seal by virtue of their communication with grooves 121 fluidly connected with the vacuum plenum 108. In order to ensure preservation of the vacuum pressure in the grooves 121, seal strips 122 fit along the stator surface to engage the rotor surface 96 on both sides of the set of fluid port rows and are connected by a further seal strip (not shown) positioned above the termination point of the grooves. The removed seal 20 is carried by the rotor until the fluid ports to which the seal is attached are placed in communication with the plenum chamber 126, whereupon the non-adhesive surface of the seal is brought into communication with pressurized air. This action reverses the pressure differential on the adhered seal 20 such that the seal is now propelled radially outward from the rotor axis 95 into the collector bin 130. The rotor 94 continues turning over the stator surface 106 and the lift-off process repeats.

The seal removal equipment 101' obviates the need for guide surfaces for the seals and pressure differential enhancement means utilized in connection with the rotor-stator assembly having a vertical axis according to the first embodiment. As illustrated in FIG. 9, bottles 10 pass through the seal removal station 100' along a line tangential with the circumferential rotor surface 96. Fluid ports 111 along the rotor surface 96 are substantially planar with the surface of each seal only at the lowermost tangential point of their curcular path over which is located the vacuum plenum 108. Due to this arrangement, upwardly curled marginal portions of the seal do not have a chance to become adhered to the downwardly facing surface of the rotor 94 prior to being located beneath the lift-off plenum. Hence, guide surface means such as arcuate surface 71 utilized in the first embodiment, for flattening out upwardly curled seal portions are unnecessary and the rotor surface 96 is put at nearly zero clearance to the upper planar surfaces of the seals 20. The close proximity of the rotor to the seals 20 obviates the need for an enhanced pressure differential for their removal.

Guide surface means, such as guide bars 70, for flattening out downwardly extending seal portions by the time the bottle mouth 18 passes beneath the vacuum plenum may be utilized with respect to this alternate embodiment in a similar fashion as described in connection with the seal removal mechanism 101. Guide rail means 12 and 14, described in connection with the seal removal mechanism 101, may also be utilized. Preferably, the guide rail means are adjustable to accommodate various bottle sizes as illustrated in FIG. 10 by the guide rail means 131. Guide rail means 131 includes horizontal alignment rails 132 and stabilizing upper guide surfaces 133. Each of these guide members is secured by adjustable screw thread attachments in fixed bracket mounting members.

The seal removal mechanism 101' is motor-driven by means of a variable speed adjustable electric motor 134. Stationary mounting means 103 support the motor 134 and drive shaft 102. Mounts 103 may be made vertically adjustable, by use of slip-fit bracket holes for the mounting bolts, to accommodate various bottle sizes. The motor 134 is connected through a gear box 136 with the rotor drive shaft 102. The motor speed is adjustable so that movement of the rotor member 94 may be set for synchronization with the conveyor speed of the bottles 10. Matching linear speeds of the pick-up surface 96 and the bottles 10 serves to reduce the possibility of toppling or otherwise destabilizing a bottle during the time when its seal is lifted off.

THE PROCESS

Figure 12:
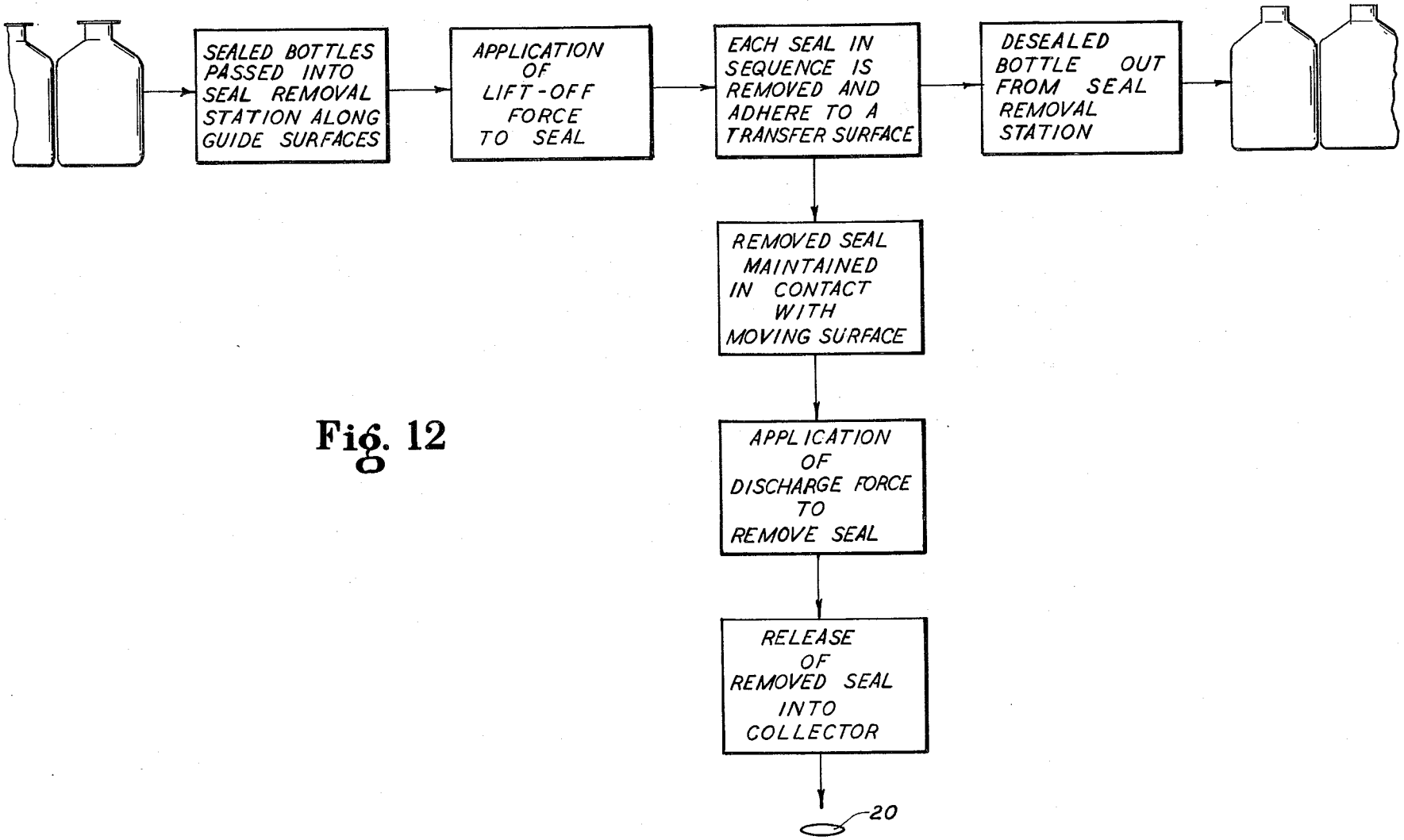
FIG. 12 is a block diagram illustrating a seal removing process according to the present invention.

While FIGS. 1–11 illustrate two forms of apparatus according to the present invention, those skilled in the art may envision other mechanical means with which to perform the seal removal process. The general steps of the inventive process are illustrated in FIG. 12. Initially, plastic bottles 10 having oversized adhesive seals 20 fitted across their mouths are propelled in seriatim fashion into the seal removal station. Preferably, the bottles pass along guide surfaces so that they may be properly aligned for the seal removal operation. The removal sequence begins with the application of forces upon a bottle seal generating an instantaneous lift-off force greater than the adhesion force of the seal on the bottle mouth. As the apparatus described above in connection with FIGS. 1–11 indicates, the lift-off force may be in the form of a fluid pressure differential occurring across the marginal overlapping portions of the seal.

Upon application of the seal lift-off force, the seal 20 is raised vertically upward from the bottle mouth 18 all at once into adherance with a movable transfer surface, such as the perforated rotor members described above. Desealed bottles 10 are passed out of the seal removal station to be filled.

Each removed seal 20 is kept in contact with the movable transfer surface which carries the seal away from the flow of bottles through the seal removal station and toward a loose seal collector. Maintaining contact of the seal on the transfer surface may be accomplished by retaining a vacuum pressure above the seal in accordance with the stator-rotor assemblies described in connection with FIGS. 1–11. At a point adjacent the collector, a discharge force, such as fluid pressure as described above, is applied to the removed seal to cause it to release from the transfer surface into the collector. The process is then repeated.

It will be understood that variations and modifications may be effected without departing from the spirit and scope of the novel concepts of this invention.

I claim as my invention:

1. An apparatus for removing oversized adhesive seals covering open mouths of containers prior to filling said containers, comprising a rotor means mounted over the containers and rotatable about a vertical axis, said rotor having a plurality of vertical air passages therethrough, a stator means disposed above said rotor, said stator being provided with first and second plenum chambers spaced from one another and facing said rotor, and means for maintaining said first plenum below atmospheric pressure and said second chamber above atmospheric pressure, and pressure means having at least one jet nozzle means in fluid connection with a source of above-atmospheric pressure, said at least one jet nozzle directing fluid pressure beneath each said seal on its respective container mouth.

2. The apparatus according to claim 1, further comprising:

guide surface means for flattening upwardly curled overlapping marginal seal portions as each said seal is passed towards said rotor.

3. The apparatus according to claim 2, wherein said guide surface being an upstanding arcuate wall mounted over said flow of containers beneath said rotor, said arcuate wall having a generally planar trailing end terminating adjacent said rotor.

4. The apparatus according to claim 2, further comprising:

further guide means for flattening downwardly curled overlapping marginal seal portions as each said seal is passed towards said rotor.

5. The apparatus according to claim 1, further comprising:

means for vertically adjusting the position of said stator and rotor member in unison.

6. The apparatus according to claim 1, further comprising:

said vertical passages being arranged in a series of concentric rings and arcuate groove means formed in said stator overlying each of the passage rings respectively and opening at its one ends into said first plenum and terminating at opposed ends prior to reaching said second plenum.

7. A method of removing oversized adhesive seals from container openings in a seal removal station as the containers are passed in seriatim into said seal removal station, said method comprising:

rotating a rotor member over said flow of containers in said station, said rotor member having a circular surface formed with fluid passages extending therethrough, mounting a stator member in a fixed position relative to said rotor in adjacent abutting relation to said rotor circular surface at a side opposed from said flow of containers and communicating with the other side through said fluid passages, said stator having formed therein first and second spaced apart plenum chambers, communicating said first plenum with sub-atmospheric pressure and said second plenum with above atmospheric pressure, passing said seals beneath said first plenum, and directing pressure air beneath each said seal on its respective container opening as said each seal passes beneath said first plenum.

8. The method according to claim 7, further comprising:

rotating said rotor about a vertical axis.

9. The method according to claim 7, further comprising:

guiding portions of said seals overlapping their container openings as the seals pass into said seal removal station such that said seals are arranged to be generally planar in the horizontal direction as they pass beneath said first plenum.

10. The method according to claim 7, further comprising:

rotating said rotor about a horizontal axis and passing said rotor surface at nearly zero clearance over said container seals as they move into said seal removal station.

* * * * *